US005734946A

United States Patent [19]

Wernicke

[11] Patent Number: 5,734,946

[45] Date of Patent: Mar. 31, 1998

[54] PROCESSING DEVICE FOR PHOTOGRAPHIC MATERIALS

[75] Inventor: Ubbo Wernicke, Rösrath, Germany

[73] Assignee: AGFA AG, Germany

[21] Appl. No.: 741,369

[22] Filed: Oct. 30, 1996

[30] Foreign Application Priority Data

Nov. 8, 1995 [DE] Germany ..... 195 41 559.0

[51] Int. Cl.[6] ..... G03D 5/06

[52] U.S. Cl. ..... 396/606

[58] Field of Search ..... 396/603, 604, 396/606, 607, 608, 614, 617, 622, 624, 626, 630, 642

[56] References Cited

U.S. PATENT DOCUMENTS

| | | | |
|---|---|---|---|
| 2,878,741 | 3/1959 | Limberger | 396/607 |
| 3,315,583 | 4/1967 | Hunt et al. | 396/606 |
| 3,330,197 | 7/1967 | Boeger et al. | 396/606 |
| 3,682,082 | 8/1972 | Stievenart | 396/396 |
| 3,714,882 | 2/1973 | Schranz et al. | 396/607 |
| 3,714,883 | 2/1973 | Hunicke et al. | 396/606 |
| 4,166,689 | 9/1979 | Schausberger et al. | 396/614 |
| 4,429,982 | 2/1984 | Martino et al. | 396/606 |
| 4,688,917 | 8/1987 | Muller et al. | 396/606 |
| 4,987,438 | 1/1991 | Goto et al. | 396/626 |
| 5,239,328 | 8/1993 | Wernicke et al. | 354/320 |
| 5,347,337 | 9/1994 | Patton et al. | 396/622 |

FOREIGN PATENT DOCUMENTS

| | | |
|---|---|---|
| 1497447 | 7/1969 | Germany . |
| 2615932 | 10/1977 | Germany . |
| 3230175 | 5/1983 | Germany . |

*Primary Examiner*—A. A. Mathews

*Attorney, Agent, or Firm*—Connolly & Hutz

[57] ABSTRACT

Processing with a particularly economical use of chemicals is achieved with a device for the wet-chemical processing of a photographic material, in which at least one processing stage comprises a rack having a plurality of rotatable rollers which are in contact with the layer surface of the material, at least one roller being encased over 30° to 300° of its circumference in such a manner that processing fluid located in the space between the roller and the casing cannot fully escape.

10 Claims, 1 Drawing Sheet

PROCESSING DEVICE FOR PHOTOGRAPHIC MATERIALS

Figure 1:
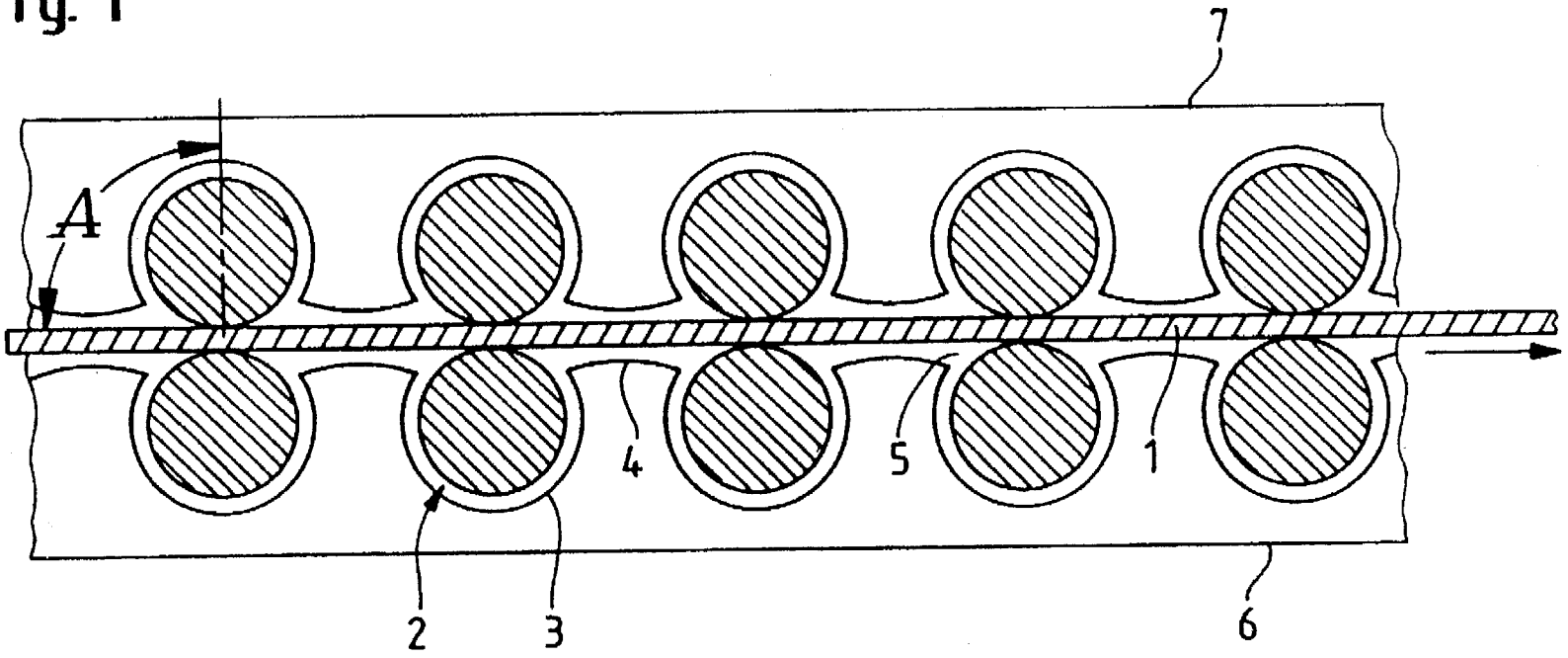

The invention relates to a device and a method for the wet-chemical processing of a photographic material which on a support comprises at least a silver halogenide emulsion layer and is processed with the steps: developing, optionally bleaching, fixing, rinsing or stabilising, it being possible to combine the bleaching and fixing in a bleach-fixing step.

More particularly, the invention relates to a device of this type which is particularly space-saving but nevertheless effective and is characterised by a particularly economical use of chemicals. Devices of this type, referred to as "minilabs", are widely used and are employed for the manufacture of colour prints by processing the exposed photographic material. In the case of a colour photographic material, preferably a colour photographic paper these minilabs usually comprise several processing stages: colour developing, bleaching, fixing, stabilising and drying.

A processing machine of this type is known from EP 501 273. A so-called rack, i.e. a frame on which a plurality of roller pairs are mounted vertically above one another, is located in a tank, the axles of the rollers being arranged parallel to the horizontal and the rollers of each roller pair lying parallel to one another.

Provided beneath the uppermost roller pair is a fluid supply. The photographic material is guided upwards through the roller pairs before being conducted into the next tank or into the drying device.

The fluid supply produces a cleaning countercurrent cascade from roller pair to roller pair. The device thus allows for a considerable saving in chemicals by preventing chemicals from being carried over into the next tank. The device also allows for a compact structure.

A problem associated with this device is that the roller pairs run dry when the machine is inoperative. If this is to be prevented, it is necessary to continuously sprinkle the rollers with fluid, even when no photographic material is being developed, which increases the fluid consumption to unacceptable levels.

It is the object of the invention to dispense with this disadvantage, without losing the advantages already obtained by way of EP 501 273.

This object is attained in that, after exposure, the photographic material is guided in at least one processing step, preferably in each processing step with the layer-surface in contact along a plurality of rollers, at least one roller being encased over 30° to 300° of its circumference in such a manner that the processing fluid located in the space between the roller and the casing cannot fully escape.

The photographic material is in contact with the rollers in the regions which are not encased. Preferably at least half of the rollers are encased as mentioned above.

The rollers of a processing stage are preferably arranged in a straight line, which forms an angle, A, of 45° to 90°, preferably 80° to 90° with the horizontal (see FIG. 1). The larger this angle, the larger the degree of encasing needs to be, so that the advantages according to the invention are obtained.

A processing stage comprises, more particularly, 2 to 100 rollers, preferably 5 to 50 rollers.

The space between the roller and the casing is kept small; the distance measures, more particularly, 0.5 to 20 mm, preferably 1 to 10 mm.

At the sides, i.e. over the end faces of the rollers, the casing is closed and merely comprises openings for the roller axles, which openings are sealed relative to the roller axles.

The casings between two successive rollers of a processing stage are preferably connected to one another.

Supplied fluid remains in the intermediate space between the rollers and the casing.

In order to have the layer surface in sufficient contact with the roller surface a part of the device is arranged in such a manner to the back side of the photographic material that the desired contact occurs automatically.

This part of the device may be a guide plate, a guide plate with burls, a plurality of small rollers, or rollers as used at the layer surface which may be mounted directly opposite the rollers used at the layer surface or in a shifted position. Also these rollers may be encased, if e.g. an x-ray material is processed which usually contains on both sides of the support light-sensitive silver halide emulsion layers.

If further liquid is added to the system beneath the uppermost roller an overflow is generated from the corresponding casing which then is directed to the casing of the next roller below.

If the rack operates with an inclination, e.g. 90°, a direction of flow is provided along an incline for the fluid supplied at the upper end of the rack, the direction of flow being selectively in the same or opposite direction to the conveying direction of the photographic material.

In the case of roller pairs it is preferred to have at least one roller of a roller pair guided in a slot so that the rollers contact one another as a result of their intrinsic weight and yield when the photographic material is transported between the roller pairs.

The pressure with which the rollers contact one another can be optionally reinforced by springs on the axle pairs.

If rollers are only provided at the layer surface also these may be guided preferably in a slot to reach the same effect.

The advantages of the structure according to the invention are:

1. Extremely low chemical volumes are used. Only the lower space between casing and rollers is filled. Consequently, the device is also suitable for one-off developing.
2. No pump circulation is required as a result of the "massage effect" of the numerous roller pairs.
3. The tempering can be effected centrally for all baths and can be effected from the outside through the wall of the casing.

The invention is explained in further detail with the aid of the drawing:

FIG. 1 is a section through a rack according to one embodiment of the invention.

FIG. 1 shows a rack of a processing stage, in which the photographic material 1 is transported in the direction of the arrow between a series of roller pairs 2. The rollers are provided with casings 3, the casings of two successive rollers being connected to one another by metal sheets 4. The resulting space 5 is sealed by walls (not shown) arranged at the end faces of the rollers and is used for receiving a fluid, e.g. a developing, bleach-fixing or stabilising solution. The rack can be arranged horizontally (as illustrated) or at a given angle as far as the vertical. The rack can be enclosed in a space indicated by the walls 6 and 7, which can be tempered, so that the process is carried out at exactly the right temperature.

The rollers are always at least partially moistened with fluid as a result of the casings. When the machine is not in operation, but where the processing solutions are not to be removed, the rollers can be rotated with a low energy consumption to prevent the non-moistened roller surface from becoming dry.

The invention also relates to a method for the wet-chemical processing of a photographic material, in which the material is in at least one processing stage guided with the layer surface along a plurality of rotatable rollers, characterised in that the material passes through a multiple cascade, each cascade stage being defined by a roller, the volume of each cascade stage being 0.2 to 5 ml/cm material width, the material not being immersed in the processing fluid between the cascade stages and at least 50% of the rollers of the processing stage being only partially immersed in the processing fluid.

The method according to the invention is preferably carried out in the device according to the invention.

Photographic materials which can be processed in the device according to the invention or by the process according to the invention, are e.g. black-and-white film, black-and-white paper, colour negative film, colour reversal film and colour negativ paper.

EXAMPLE 1

(Comparison)

A conventional photographic paper, e.g. Agfacolour type 10 is automatically processed according to the standardised Kodak RA 4 developing process.

The photographic material is guided through six different tanks:

| | | | |
|---|---|---|---|
| developing | 45 sec | 38° C. | tank 1 |
| bleach-fixing | 45 sec | 38° C. | tank 2 |
| stabilising | stage 1 | 22.5 sec | tank 3 |
| | stage 2 | 22.5 sec | tank 4 |
| | stage 3 | 22.5 sec | tank 5 |
| | stage 4 | 22.5 sec | tank 6 |
| drying | | | |

The tank volume of tanks 1 and 2 is 20 l.

The tank volume of tanks 3 to 6 is 10 l.

Stabilisation is effected in a 4-stage counterflow cascade.

With the prescribed replenishment rate of 250 ml/m$^2$ and a carry over rate of 50 ml/m$^2$, there is a dilution of the carried-over bleach-fixing bath to 1/6 per stabilising stage. As a first approximation, the content in the bleach-fixing bath in stage 4 is therefore less than 1/1,000 of the concentration in tank 2 with the replenishment in equilibrium, i.e. after a throughput of approximately 100 m$^2$ colour paper.

The cleanliness of the photographic material, i.e. the absence of iron compounds and silver thiosulphate compounds from the bleach-fixing bath is decisive for the durability of the photographic material during storage—particularly in the case of moist-warm storage.

Consequently, if the stabilisation is reduced from 90 to 45 seconds in the existing processing system by halving the duration per stage, then this results in a marked impairment in the picture whiteness after 40 days storage at 35° C. and 90% relative air humidity.

Measurement of the minimum density of Agfacolour type 10 after 40 days at 35° C./90% relative air humidity.

| | blue | green | red |
|---|---|---|---|
| stabilisation 90 sec | 0.17 | 0.16 | 0.11 |
| stabilisation 66 sec | 0.21 | 0.18 | 0.12 |
| stabilisation 45 sec | 0.26 | 0.20 | 0.13 |

EXAMPLE 2

(Invention)

As in Example 1, the photographic material is developed and bleach-fixed and then passes for 45 seconds upwards through a rack according to the invention comprising 18 roller pairs according to FIG. 1, each of which is only partially immersed in the stabilising solution. As in Example 1, the regeneration quota is 250 ml/m$^2$. The roller pairs are encased over 120°. The distance between the casing and the roller surface measures 2 mm in each case. The casing is arranged in such a manner that in each stage the fluid volume of stabilising solution per cm material width, which cannot escape, is about 2.7 ml.

In spite of the reduced stabilising time, the minimum densities after 40 days storage at 35° C./90% relative air humidity are:

| blue | green | red |
|---|---|---|
| 0.17 | 0.16 | 0.11 |

I claim:

1. A device for the wet-chemical processing of a photographic material, in which at least one processing step comprises at least one rack having a plurality of rotatable rollers which are in contact with the layer surface of the material, said rollers of said rack are arranged in a straight line, which forms an angle of 45° to 90° with the horizontal wherein at least one roller is encased over 30° to 300° of its circumference with a casing in such a manner that processing fluid located in the space between the roller and the casing cannot fully escape and wherein the distance between the roller surface and the casing is 0.5 to 20 mm.

2. The device according to claim 1, wherein the casing of successive rollers is connected to one another.

3. The device as claimed in claim 1, wherein there are 2 to 100 rollers.

4. The device as claimed in claim 3, wherein at least half the rollers are encased.

5. The device as claimed in claim 1, wherein there are 5 to 50 rollers.

6. The device as claimed in claim 4, wherein said space between said rollers and said casing is between 1 to 10 mm.

7. The device according to claim 1, wherein the rollers of a rack are arranged in a straight line, which forms an angle of 80° to 90° with the horizontal.

8. A method for the wet-chemical processing of a photographic material, the layer surface of the material being guided in at least one processing stage along a plurality of rotatable rollers, which comprises passing the material through a multiple cascade, each cascade stage being defined by a roller, the volume of each cascade stage measuring 0.2 to 5 ml/cm material width, the material not being immersed in the processing fluid between the cascade stages and at least 50% of the rollers of the processing stage being only partially immersed in the processing solution and wherein at least one roller is encased over 30° to 300° of its circumference with a casing and the distance between the roller surface and the casing is 0.5 to 20 mm.

9. The method according to claim 8, wherein the method is carried out in a device for the wet-chemical processing of a photographic material, in which at least one processing step comprises at least one rack having a plurality of rotatable rollers which are in contact with the layer surface of the material, wherein at least one roller is encased over 30° to 300° of its circumference with a casing in such a manner that processing fluid located in the space between the roller and the casing cannot fully escape.

10. The method according to claim 8, wherein the overflow of the processing liquid in the casing is guided to the next casing of the roller below.

* * * * *